United States Patent [19]

Berke

[11] Patent Number: 4,850,886

[45] Date of Patent: Jul. 25, 1989

[54] POWER CORD DECOUPLER AND METHOD

[76] Inventor: Joseph J. Berke, 2063 Long Lake Shore, West Bloomfield, Mich. 48033

[21] Appl. No.: 150,690

[22] Filed: Feb. 1, 1988

[51] Int. Cl.[4] ..... H01R 13/629

[52] U.S. Cl. ..... 439/152; 439/476

[58] Field of Search ..... 439/152, 476, 501, 604–606

[56] References Cited

U.S. PATENT DOCUMENTS

| | | | |
|---|---|---|---|
| 1,804,474 | 5/1931 | Martin | 439/476 |
| 2,292,140 | 8/1942 | Lofgren | 439/501 |
| 3,160,947 | 12/1964 | Sunderlin | 439/152 |
| 3,249,909 | 5/1966 | Kowalewski | 439/606 |

FOREIGN PATENT DOCUMENTS

| | | | |
|---|---|---|---|
| 1112156 | 8/1961 | Fed. Rep. of Germany | 439/604 |

*Primary Examiner*—Joseph H. McGlynn
*Attorney, Agent, or Firm*—Alex Rhodes

[57] ABSTRACT

A decoupler and method for decoupling a plug of a power cord from the electrical outlet. The device comprises at least one flanged means which is adaptable to be grasped by a user's fingers to exert a pulling force at a distance from the plug to decouple the plug from the outlet and means for retaining the decoupler to the power cord. The method comprises the steps of selectively positioning a flanged means on the wire of a power cord at a distance from the plug of the cord; fixing the flanged means to the power cord, grasping the flanged means with a user's fingers; and applying a pulling force to the flanged means with the user's fingers to decouple the plug from an electrical outlet.

12 Claims, 1 Drawing Sheet

POWER CORD DECOUPLER AND METHOD

BACKGROUND OF THE INVENTION

This invention relates to electrical power cords and more particularly to a decoupler and method for decoupling a plug of a power cord from an electrical outlet, by way of example, in a home or office. When decoupling a plug from an electrical outlet, it is a common practice to grasp and exert a pulling force on the wire attached to the plug with the entire fist rather than the plug. This is due to the natural reluctance of many persons to be near electrical outlets, the low and variable locations of wall outlets and the sometimes inaccessibility of wall and ceiling outlets.

When an excessive pulling force is indiscriminately exerted by the entire fist on the wire, the lateral component of the pulling force may damage the wire, plug and outlet and/or cause electrical shock.

Manufacturers have addressed this problem by strengthening the attachments of wires to plugs of power cords. However, this has provided only partial relief and further improvements would be provided with a decoupler which was particularly adapted for grasping the wire with a user's fingers, at a distance from the plug. Such a device would recognize the practice of many users, i.e. of grasping the wire rather than the plug, and consequently reduce their exposure to electrical shock and/or reduce damage to power cords, plugs and outlets.

SUMMARY OF THE INVENTION

The present invention is directed to the task of decoupling a power cord plug from an electrical outlet and more particularly to a convenient, effective, easy to use, decoupler and method for grasping and applying a pulling force to a power cord with a user's fingers at a distance from the plug. In addition to its convenience, the invention will find favor with persons who are reluctant to grasp power cord plugs, reduce their exposure to electrical shock and/or reduce damage to cords, plugs and outlets. These benefits are derived by exerting decoupling forces to wires of power cords with fingers rather than entire fists at distances from power cord plugs.

The decoupler comprises a collar or flange attached to the wire at a distance from the plug. The collar or flange may be formed integrally with the cord at a fixed distance from the plug or be selectively adjustable to apply decoupling forces with fingers rather than entire fists at distances from power cord plugs.

The method for decoupling the plug from the outlet comprises the steps of selectively positioning a collar or flange on the wire portion of a power cord at a distance from the plug, grasping the collar or flange with the user's fingers and applying a pulling force with the user's fingers to the collar or flange to decouple the plug from the outlet.

One feature of the invention is that it can be readily applied to existing power cords without modifications to the power cords.

It is a primary object of the present invention to provide an economical means and method for decoupling a power cord from an electrical outlet which is safe, convenient, effective, and easy to use.

It is another object, in addition to the foregoing object, to provide means for decoupling a power cord from an electrical outlet which is adapted to the current practice of grasping the wire portion of a power cord.

It is a further object, in addition to the foregoing objects, to provide a decoupler which is adaptable to a variety of power cord gauges and styles.

It is another object, in addition to the foregoing objects, to provide a decoupler which is adaptable to a variety of power cord gauges and styles.

Further objects, advantages and benefits will be apparent from the ensuing description and accompanying drawings which disclose the invention in detail. The best mode contemplated in practicing the invention is disclosed and the subject matter in which exclusive rights are claimed is set forth in each of the numbered claims at the conclusion of the detailed description.

DETAILED DESCRIPTION OF THE PREFERRED EMBODIMENT

Figure 1:
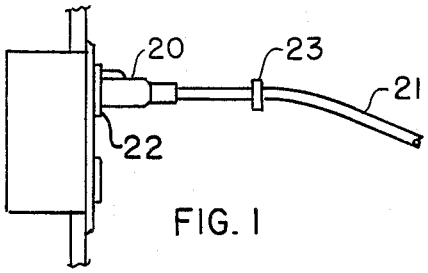
FIG. 1 is a side view of a power cord coupled to an outlet with a decoupler at a distance from the plug of the power cord.

Referring now to the drawings wherein like numerals designate like and corresponding parts throughout the several views, the decoupler comprises a collar or flange, adapted to be grasped with the fingers of a user at a distance from the plug.

Figure 2:
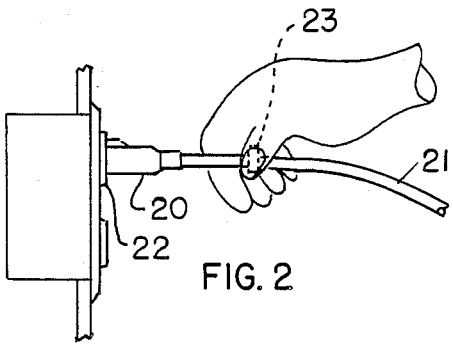
FIG. 2 shows the grasping of the decoupler for decoupling the power cord plug from the electrical outlet.

The invention can be best understood by referring to FIG. 2, wherein a user is in the process of decoupling the plug 20 of a typical power cord 21 used for appliances, office equipment and small power tools and the like, from an outlet 22. In the embodiment of FIGS. 1 and 2, a circular collar 23 is made integral with or adhesively bonded to the power cord 21. The plug 20 is positioned at a fixed distance from the plug 20 and is adapted to be grasped by the user's fingers 24 to exert a pulling force for decoupling the plug 20 from the outlet 22.

The preferred location of the decoupler 23 with respect to the plug 20 is established by the needs of a user. In some cases, by way of example counter-top outlets, it may be most convenient to locate the decoupler 23 close to the plug 20. If the outlet 22 is not readily accessible or close to a floor, or the user is physically incapacitated, it may be desirable to locate the decoupler 23 at a greater distance from the plug 20.

Figures 3, 4:
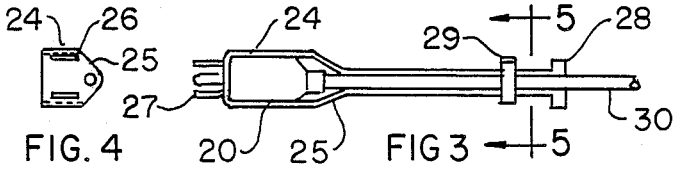
FIG. 3 is a plan view of a power cord with an alternate embodiment of the decoupler attached to the power cord.
FIG. 4 is a left end view of the power cord and decoupler shown in FIG. 3.
Figure 10:
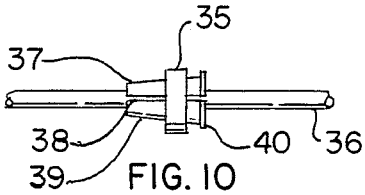
FIG. 10 is a side view of a power cord and another alternate embodiment of the decoupler which can be adjustably positioned on the power cord.
Figure 12:
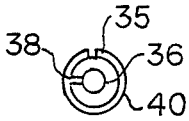
FIG. 12 is a right end view of the power cord and decoupler shown in FIG. 10.
Figure 13:
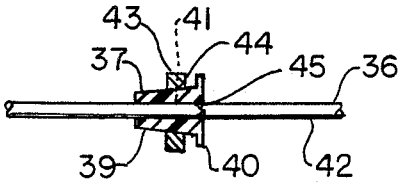
FIG. 13 is a sectional view taken on the line 13—13 of FIG. 11.
Figure 14:
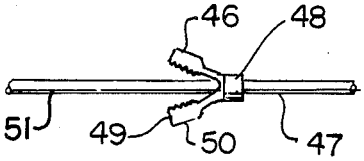
FIG. 14 is a plan view of a power cord and an adjustable decoupler with a pair of jaws.
Figure 15:
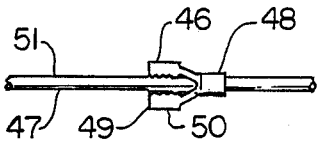
FIG. 15 is a plan view of the power cord and decoupler shown in FIG. 14 with the jaws in closed position.
Figure 16:
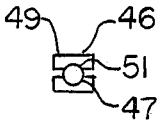
FIG. 16 is a left end view of the power cord and decoupler shown in FIG. 15.
Figure 17:
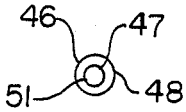
FIG. 17 is a right end view of the power cord and decoupler shown in FIG. 15.

One feature of the invention is that it is readily adaptable to existing power cords. Moreover, it may be molded in place or adhesively bonded to a power cord 20 by a manufacturer as shown in FIG. 1, or mechanically attached as shown in FIGS. 3, 10 and 14.

Figure 5:
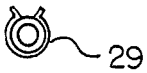
FIG. 5 is a sectional view taken on the line 5—5 of FIG. 3.
Figure 6:
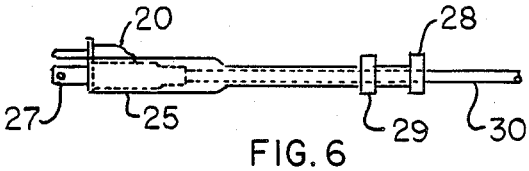
FIG. 6 is a side view of the power cord and decoupler shown in FIG. 3.
Figure 7:
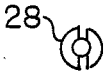
FIG. 7 is a right end view of the power cord and decoupler shown in FIG. 3.
Figure 8:
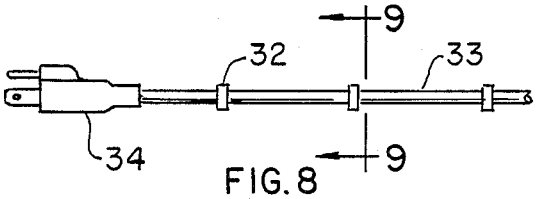
FIG. 8 is a side view of a power cord with multiple decouplers spaced apart on the power cord.
Figure 9:
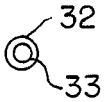
FIG. 9 is a sectional view taken on the line 9—9 of FIG. 8.
Figure 11:
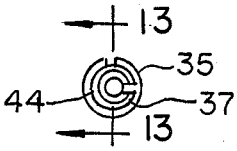
FIG. 11 is a left end view of the power cord and decoupler shown in FIG. 10.

The embodiment 24 shown in FIGS. 5 through 7, inclusive, is adaptable to existing cords and comprises a thin narrow folded strap 25 with apertures 26 in the center portion for receiving the terminals 27 of a plug 20 and flanged end portions 28 for applying a force with a user's fingers. The decoupler 25 is fixed to the wire 30 of a power cord 31 by a spring clip 29 which retains the ends of the folded strap 25 to the power cord 31. It will be appreciated that with this embodiment 24, the decoupling force is not transmitted through the wire 30, but rather acts directly on the plug 20.

When the invention is to be used under a variety of conditions, multiple collars 32 may be provided at intervals along the wire 33 of the power cord 34 as shown in FIGS. 6 and 7. The arrangement of circular collars 32 provides a user with the option of selectively grasping a collar 32 at varying locations to decouple plugs from outlets.

An alternative to multiple collars is shown in FIGS. 10–13 and is adjustably positionable along the wire 42 of a power cord 36 at varying distances from its plug (not shown). The decoupler 35, preferably made of a resilient material, has a body 37 which is divided lengthwise by a gap 38, a tapered portion 39 and an adjoining shoulder portion 40. Extending axially through the body 37 is an aperture 41 for receiving the wire 42 of the power cord 36. At one end of the aperture 41 is an inwardly extending pointed projection 45.

The body 37 is frictionally retained to the power cord 36 by a split cylindrical collar 43 having a tapered aperture 44 which engages the tapered portion 39 of the body 37. The taper of the aperture 44 corresponds to the taper of the body 37 and its angle is preferably small enough to produce a locking condition with the tapered body portion 39 when the collar 43 is forcibly engaged with the body 37, the particular angle of taper depending upon the coefficient of friction of the materials.

The adjustable decoupler 35 is fixed to the wire 42 of the power cord 36 by assembling the collar 43 to the wire 42 and then forcibly engaging the collar 43 with the body 37 to tightly engage the pointed projection 45 of the aperture 41 with the wire 42.

Referring now to FIGS. 14–17, another embodiment 46 is disclosed therein which is selectively positionable to varying distances from the plug (not shown) of a power cord 47. The decoupler 46 is made of a resilient material and comprises a short tubular portion 48 slideably mounted on the wire 51 and adjoining toothed jaw portions 49 which deflect inwardly and grip the wire 51 when a force is applied with a user's fingers to finger pads 50 of the jaw portions 49. After the wire 51 has been tightly gripped, a pulling force is applied by the user's fingers to decouple the plug (not shown) from an outlet.

From the foregoing, it will be appreciated that the present invention provides a means and method for decoupling a plug of a power cord from an electrical outlet by applying a force with fingers, rather than entire fists, at a distance from the plug. Moreover, the decoupler and method are convenient, safe, easy to use, reduce the exposure of users to electrical shock and/or damage to wires, plugs and outlets.

Although but several embodiments of the invention have been disclosed and described it will be understood that other embodiments can be derived by changes in the size, shape, material and substitution of parts without departing from the spirit thereof.

I claim:

1. In combination with an electrical power cord having a plug operatively connected to one end of a wire for operatively connecting said wire to an electrical outlet, a decoupler for decoupling said plug from said outlet comprising at least one collar which is detached from said plug and fixed in embracing relationship to the wire at a distance from said plug, said collar being adapted to be grasped by a user's fingers to exert a pulling force at a distance from said plug; and a means for affixing said decoupler to the wire at a distance from said plug.

2. The combination recited in claim 1 wherein said collar is formed integral with said wire.

3. The combination recited in claim 1 wherein said collar is a circular collar.

4. The combination recited in claim 1 further comprising a plurality of unconnected collars detached from said plug and located at varying distances from said plug, each collar being in embracing relationship to said wire and adapted to be grasped by the fingers of a user to exert a pulling force at a distance from said plug.

5. The combination recited in claim 1 wherein said collar comprises: aligned half portions of a split collar and a thin narrow folded strap interconnecting said half collar portions and having apertures in the center portion thereof for receiving the terminals of a plug and said half collar portions being adapted to be grasped with a user's fingers to exert a pulling force at a distance from said plug; and a circular spring clip tightly embracing said folded strap for retaining the folded strap and adjoining half collar portions to a power cord.

6. The combination recited in claim 1 wherein said decoupler is selectively positionable on said wire to vary the distance of said decoupler from said plug, said decoupler comprising a tubular portion for slideably engaging the wire of a power cord and adjoining resilient jaw collar portions embracing said wire for tightly gripping said wire when a force is applied with said user's fingers to deflect said collars inwardly to exert a pulling force with the user's fingers at a distance from said plug.

7. The device recited in claim 1 wherein said means for affixing said decoupler to said wire is an adhesive.

8. The device recited in claim 1 wherein said means for affixing said decoupler to said wire is a friction means.

9. The device recited in claim 1 wherein said means for affixing said decoupler to said wire is a gripping means.

10. In combination with an electrical power cord having a plug operatively connected to one end of a wire for operatively connecting said wire to an electrical outlet, a decoupler for decoupling said plug from said outlet comprising: a resilient body, said body having a tapered portion, an adjoining end shoulder portion, an aperture extending axially through the body, and an inward pointed projection extending circumferentially around said aperture; and a cylindrical collar having a tapered aperture for enaging the conical half portions of the body, to retain said body to said wire and adapted to be grasped by a user's fingers to exert a pulling force at a distance from said plug.

11. A method for decoupling an electrical plug operatively connected to a wire of a power cord for an outlet comprising the steps of: grasping a collar on said wire which is detached from said plug and fixed in embracing relationship to the wire at a distance from said plug with the fingers of a user; and applying a pulling force to said collar with the user's fingers to decouple the plug from the outlet.

12. The method for decoupling an electrical plug operatively connected to a wire of a power cord from an outlet recited in claim 11 further comprising the initial step of selectively positioning said collar on the wire of the power cord at a distance from the plug.

* * * * *

UNITED STATES PATENT AND TRADEMARK OFFICE

CERTIFICATE OF CORRECTION

PATENT NO. : 4,850,886

DATED : July 25, 1989

INVENTOR(S) : Joseph J. Berke

It is certified that error appears in the above-identified patent and that said Letters Patent is hereby corrected as shown below:

In the specification, column 2, lines 4 and 5, "to provide a decoupler which is adaptable to a variety of power cord gauges and styles." should read --to reduce the damage to power cord wires and plugs and electrical outlets.--

Signed and Sealed this

Twenty-second Day of May, 1990

*Attest:*

*Attesting Officer*

HARRY F. MANBECK, JR.

*Commissioner of Patents and Trademarks*